United States Patent [19]

Meyer

[11] 4,427,185

[45] Jan. 24, 1984

[54] METHOD AND APPARATUS FOR GASEOUS CLEANING OF ALUMINUM

[75] Inventor: Clifford J. Meyer, Terre Haute, Ind.

[73] Assignee: Atlantic Richfield Company, Denver, Colo.

[21] Appl. No.: 444,537

[22] Filed: Nov. 26, 1982

[51] Int. Cl.[3] ..... C22B 21/06

[52] U.S. Cl. ..... 266/220; 75/68 R; 164/266

[58] Field of Search ..... 266/217, 218, 220, 227, 266/215; 75/93 E, 68 R; 164/266; 422/231, 228; 261/123

[56] References Cited

U.S. PATENT DOCUMENTS

| | | | |
|---|---|---|---|
| 3,676,105 | 7/1972 | McLeod et al. | 75/68 R |
| 3,694,190 | 9/1972 | Langston | 75/68 R |
| 3,737,305 | 6/1973 | Blayden et al. | 75/68 R |
| 4,007,923 | 2/1977 | Chia | 266/217 |
| 4,137,073 | 1/1979 | Singleton | 75/68 R |
| 4,235,627 | 11/1980 | Dantzig et al. | 75/68 R |
| 4,290,590 | 9/1981 | Montgrain | 266/225 |
| 4,298,187 | 11/1981 | Dantzig et al. | 75/68 R |

*Primary Examiner*—M. J. Andrews

*Attorney, Agent, or Firm*—Allegretti, Newitt, Witcoff & McAndrews, Ltd.

[57] ABSTRACT

A gas sparging apparatus particularly useful with molten aluminum includes a sparging box having an inlet, an outlet for the metal with a plurality of baffles arranged to alternately project from the top and bottom of the box into the molten metal stream. The bottom of the box also includes a graphite block connected with a manifold structure. The graphite block is gas permeable so that a sparging or cleaning gas may flow through the block into the molten metal stream to purify the metal.

5 Claims, 6 Drawing Figures

METHOD AND APPARATUS FOR GASEOUS CLEANING OF ALUMINUM

BACKGROUND OF THE INVENTION

This invention relates to the method and apparatus for purifying or cleaning molten aluminum by means of gas sparging.

The practice of sparging molten metal by passing gas upwardly through a moving stream of such metal in order to purify or clean impurities from the stream of metal has been taught by various prior art patents. For example, Blayden, et al in U.S. Pat. No. 3,737,305 discloses apparatus for passing a fluxing gas through molten aluminum as the aluminum moves through a bed of refractory bodies. The molten aluminum flows through a refractory bed and under a baffle positioned in the molten metal stream. As the metal flows under the baffle, a stream of fluxing gas is introduced to bubble upwardly through the refractory bed and the molten metal on the upstream side of the baffle. The fluxing gas interacts with impurities in the aluminum and transports the impurities to the top of the molten stream on the upstream side of the baffle. The impurities may then be skimmed from the molten metal.

Montgrain in U.S. Pat. No. 4,290,590 discloses another apparatus for gas sparging wherein gas bubbles are directed upwardly through a series of spaced nozzles arranged in a trough or furnace. The nozzles are arranged to prevent lateral spread of the bubbles and to hold down bubble size thereby increasing the efficiency of the sparging apparatus. Dantzig, et al in U.S. Pat. No. 4,298,187 discloses yet another apparatus for gas sparging. The Dantzig et al device includes a baffle positioned in the path of a stream of molten metal flow. Gas is bubbled upwardly through a special nozzle discharge device on the upstream side of the baffle.

While the aforesaid gas sparging apparatus appear to be quite useful, improved methods and apparatus for purifying or cleaning molten metals have been sought. This is especially true with respect to molten aluminum. The present invention relates to such an improved apparatus and method.

SUMMARY OF THE INVENTION

Briefly, the present invention of an improved apparatus for sparging molten metal, particularly molten aluminum, including a sparging box having an inlet at one side and an outlet at the opposite side for the molten metal. The box also includes an open top and a base assembly. A plurality of spaced baffles are suspended from the top and project into the path of molten metal flow through the box. A plurality of baffles also extend upwardly from the base assembly and in combination with the downwardly extending baffles define a serpentine path for the molten metal flowing through the box. The base assembly also includes a shaped graphite block which is gas permeable. A gas manifold is attached to the block to provide gas for flow through the block and upwardly through the molten metal as the metal flows in the serpentine path through the box. Preferably the graphite block includes a plurality of parallel ribs arrayed in the direction of molten metal flow through the box. Also, a longitudinal passage is provided for each rib in the block. The passages are connected to the manifold and act to distribute the gas through the block.

Thus, it is an object of the present invention to provide an improved gas sparging method and apparatus.

A further object of the present invention is to provide an improved gas sparging apparatus which includes a series of baffles arranged to direct molten metal in a serpentine path during the gas sparging operation so as to thoroughly mix the metal and enhance coaction of the metal and the cleaning gas.

Another object of the present invention is to provide an improved method and apparatus for distribution of a cleaning or sparing gas uniformly through the molten metal as the metal flows continuously through the gas sparging box.

Another object of the invention is to provide a gas sparging apparatus and method which is efficient, economical, easy to assemble and easy to monitor in use.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
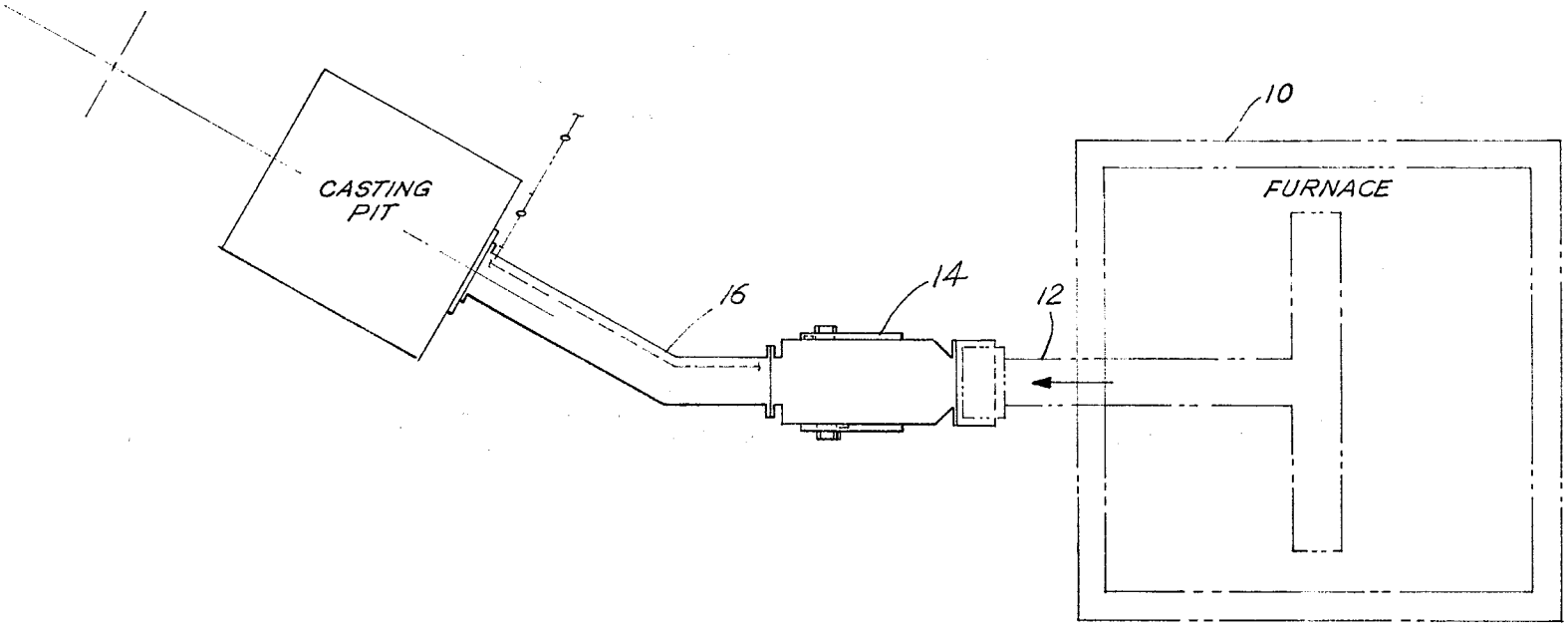
FIG. 1 is a top plan view of a typical layout for an aluminum casting operation which includes the improved gas sparging apparatus of the present invention.

Referring first to FIG. 1, there is illustrated in a top plan view the general layout of an aluminum casting operation which incorporates the improvement of the present invention. That is, aluminum furnace 10, such as a reverberatory furnace, includes a molten metal outlet chute 12 which discharges molten aluminum to a sparging box 14. The aluminum is treated in its molten state in the sparging box 14 to clean or remove impurities from the aluminum. The treated aluminum is discharged through a sparging box outlet chute 16 and flows toward a casting pit. The transfer chutes or lines 12, 16 as well as the sparging box 14 are appropriately insulated with refractory material to maintain the aluminum or other metal in a molten state during treatment and transfer.

Figure 2:
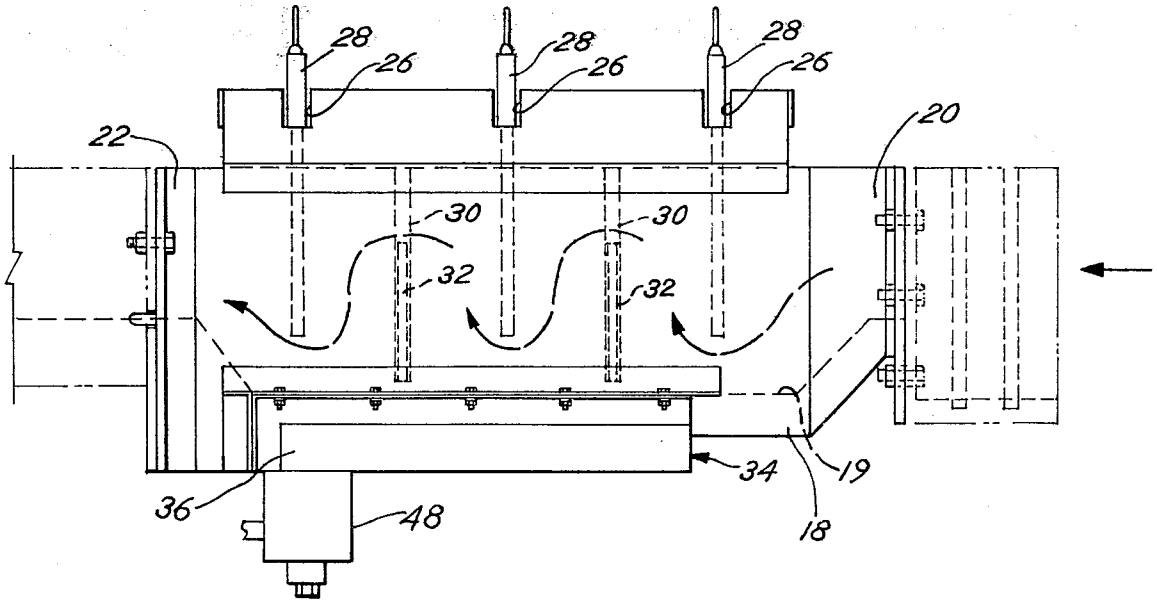
FIG. 2 is a side elevation of the gas sparging apparatus of the present invention.
Figure 3:
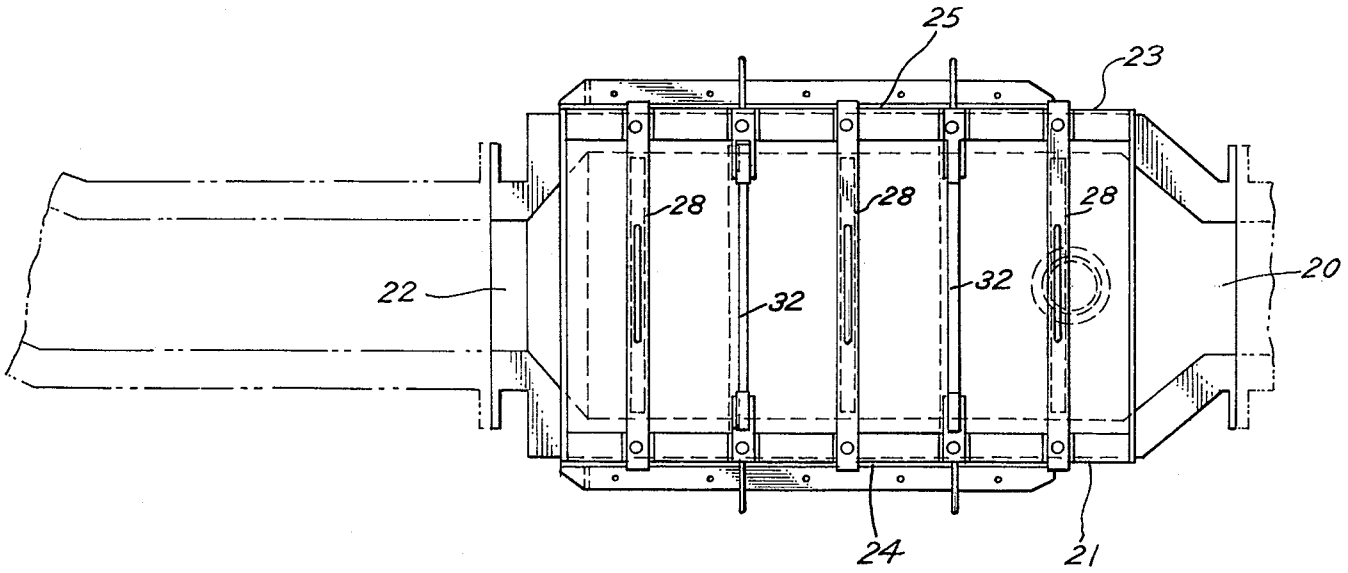
FIG. 3 is a top plan view of the box of FIG. 2.
Figure 4:
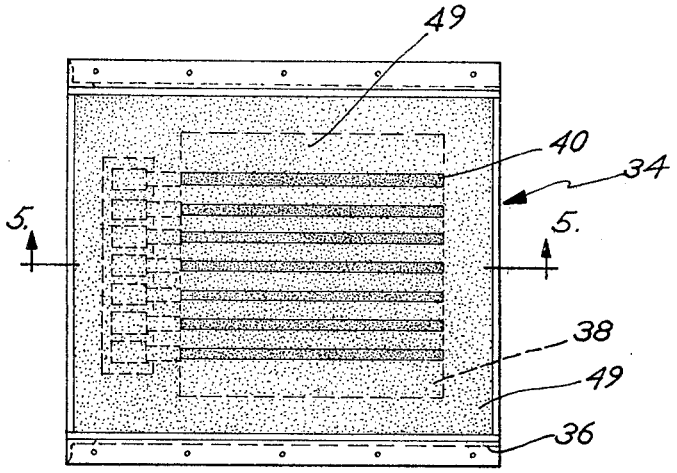
FIG. 4 is a top plan view of the bottom assembly of the gas sparging apparatus of the present invention.
Figure 5:
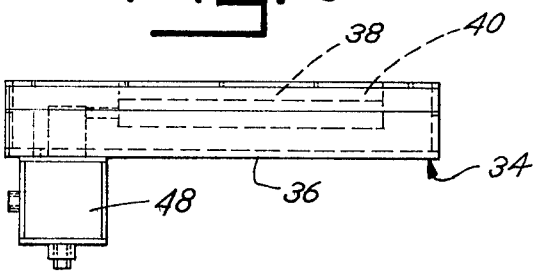
FIG. 5 is a side plan view of the assembly of FIG. 4.
Figure 6:
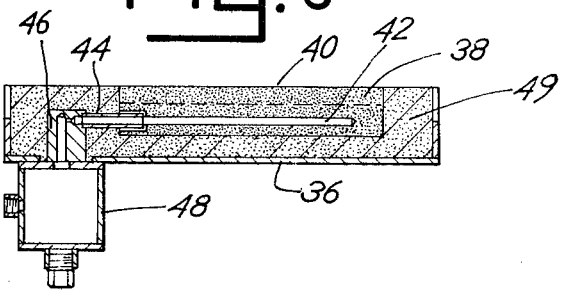
FIG. 6 is a side cross sectional view of the assembly of FIG. 4 taken substantially along the line 6—6.

FIG. 2 is a side elevation illustrating the detailed structure of the sparging box 14. FIG. 3 is a top plan view and FIGS. 4–6 illustrate in greater detail a bottom assembly 34 associated with the sparging box 14. Thus, referring to the remaining figures, sparging box 14 includes a main body or trough 18 having an open inlet 20 at one side and a discharge outlet 22 at the opposite side. Molten aluminum enters the trough 18 at the inlet 20 and flows as a continuous stream toward the outlet 22. Bottom surface 19 of trough 18 is recessed and lower than the inlet 20 and outlet 22.

Positioned on top of the trough 18 are side baffle support members 24, 25. Support members 24, 25 constitute parallel plates which extend upwardly from each side 21, 23 of the trough 18. The plates 24, 25 each have a series of opposed, spaced notches 26. Since the plates 24, 25 are arranged on each side 21, 23 of the trough 18, the notches 26 cooperate with baffle plates 28 to support the plates 28. Plates 28 are flat, refractory plates that are supported by the plates 24, 25 and extend downwardly into the interior of the trough 18 below the level of the bottom surface of the inlet 20 and outlet 22. Baffle plates 28 extend from one side 21 to the outer side 23 of the trough 18. The baffle plates 28 also extend downwardly into the path of the molten metal stream a distance approximately ¾ of the depth of the stream. Thus, molten metal will flow under the baffle plates 28 when the box 14 is in operation. Note the top of the trough 18 remains open for access to the space between baffle plates 28.

A series of parallel side slots 30 are arranged in the side walls 21, 23 of the trough 18 for receipt of additional baffle plates 32 which are supported in the slots 30. The baffle plates 32 ride on the bottom 19 of the trough 18 and extend upwardly approximately ¾ of the depth of the molten metal stream which flows through the trough 18. Note that all of the baffle plates 28 and 32 are made from a refractory material which is non-reactive with the molten metal being processed. Additionally, all the baffle plates 28, 32 are equispaced, extend substantially vertically and are arranged in parallel array transverse to the direction of the molten metal flow. The baffle plates 28, 32 thus define a serpentine or sinusoidal path for molten metal flow through the trough 18. Molten metal flows beneath the baffle plates 28 and over the top of the baffle plates 30. This ensures a proper mixing and motion of the metal as the metal is engaged by a cleaning gas.

The cleaning gas (for example, an argon clorine mixture for aluminum) is introduced to the molten metal stream through bottom assembly 34 which defines the bottom side of the trough 18. The bottom assembly 34 is comprised of a metal pan 36 which serves as a receptable or support for a graphite block 38. The graphite block 38 is formed by a molding or cutting operation with a plurality of spaced parallel ribs 40 which are arrayed in the direction of molten metal flow in the trough 18. The ribs are spaced approximately 1½ times their thickness. The graphite block 38 is a gas permeable material. A series of passages 42 are drilled or cut into the block 38. One passage 42 is positioned beneath each rib 40. One end of the passage 42 is connected by means of a orifice connection 44 through a connecting passageway 46 to a manifold 48. The manifold 48 is, in turn, connected with a source of sparging gas such as a chlorine argon mixture for aluminum metal. Gas supplied under pressure to the manifold 48 will flow through the inlet passage 46, orifice connection 44 and into gas passages 42. There the gas will permeate through the ribs 40 of the carbon block 38 and flow upwardly through molten metal that is passing through the trough 18.

The graphite block is retained in position by refractory material 49 which is placed within the pan 36. The refractory is filled over the graphite block 38 to form a surface which is level with the top of the parallel ribs 40. Thus the ribs 40 have their top surface exposed to the flowing molten metal and lie in the plane of bottom 19. Further, the gas then permeates through the ribs 40 into the molten metal. Additional refractory material lines the inner sides of the trough 18. Thus, the molten metal is retained in the molten state as it flows through the trough 18. The molten metal is unreactive with respect to the refractory material. As the molten metal flows through the trough 18, gas permeates through the block 38 and flows through the molten metal sparging the metal of impurities. Since the top of the trough is open, these materials may be slaked from the top of the trough periodically.

Following is a specific example of the construction, method and means of operation of apparatus made in accordance with this invention:

EXAMPLE

A sparging box having the following dimensions was provided:

Width: 22"

Length: 35½"

The sides of the box were coated with a two inch layer of castable type aluminum oxide refractory material and the bottom was coated with a four inch layer of refractory material.

Three baffles were suspended from the top of the box and extend into the box. The baffles are spaced at five inch intervals with the first baffle spaced five inches from the molten metal inlet. The three baffles had their lower edge elevated three inches above the bottom of the trough.

Two baffles, eight inches in height projected upward from the base of the trough. The upwardly projecting baffles were positioned midway between the suspended baffles. All baffles are fabricated from refractory material.

Molten aluminum at varying temperatures was fed through the box at varying rates. The aluminum was maintained at a depth of about seven inches in the eight inch feed trough.

Graphite ribs having a total surface area of forty-nine square inches were exposed to the molten aluminum at the bottom of the trough. Seven ribs having a length of fourteen inches and a width of one-half inch are provided with spacing between the ribs being one inch. A three-eighths inch diameter passage is positioned one and three-quarters inches below the top of each rib in the graphite block.

An argon-chlorine gas mixture in the ratio of about 95% to 5% is fed through a manifold at approximately 120 SCFM to 360 SCFM under a pressure of fifteen PSIG.

The gas was observed to permeate the molten aluminum and collect impurities in the form of dross at the top of the trough. This dross was periodically slaked.

Approximately 50% the soluable gas is removed in this manner.

While there has been set forth a preferred embodiment of the invention, it is to be understood that the invention is to be limited only by the following claims and their equivalents. Moreover, it is to be understood that various changes and alteration of the apparatus and method are contemplated, yet are considered to be within the spirit and scope of the invention. For example, the particular material chosen as the gas permeable block may be changed. Also, the pattern of the permeable surface defined by the block may be altered or changed. Additionally, the specific pattern and spacing of the baffles may be altered or changed. Also, inclusion or exclusion of ascending or descending baffles is optional. The number of baffles is also a matter of choice.

What is claimed is:

1. Improved apparatus for sparging molten metal comprising, in combination:

a sparging box having opposite sides partially defining a flow channel for molten metal, an end with a molten metal inlet at said end and an opposite end with a molten metal outlet at said opposite end, said box also including an open top and a base assembly extending between the sides and ends to define the flow channel, said base assembly including a generally planar, horizontal surface defining an internal surface for the box;

a plurality of removable, vertical, spaced baffles in the box extending between the sides, transverse to the direction of metal flow through the box, alternate ones of said baffles supported from the top and spaced from the base, the remaining intermediate baffles resting on the bottom surface and extending partially from said bottom surface upward to define a serpentine pathway for the metal flow through the box; and said base assembly also including a shaped, gas permeable block in the assembly, said block permeable to a sparging gas flow, said block having a portion thereof defining a plurality of discrete, surface areas for discharge of sparging gas into a molten metal stream in the box, said surface areas lying in the plane of the bottom surface; and said block including means for transport of a gas flow through the block.

2. The improvement of claim 1 wherein said block includes parallel, spaced ribs, each rib aligned substantially transverse to the baffles and parallel to the direction of metal flow, each rib having a top surface and defining the discrete block surface areas.

3. The improvement of claim 2 wherein the spaces between the ribs of the shaped block are filled to the level of the bottom surface with a non-gas permeable refractory material.

4. The improvement of claim 2 including a manifold structure connected with the means for transport of gas in the block, said manifold including a gas inlet and a plurality of gas outlets, one outlet connected to the block adjacent each rib.

5. The improvement of claim 4 wherein the block includes an internal passage in each rib connected with an outlet of the mainfold, said passages generally parallel to the ribs.

* * * * *